US005957530A

United States Patent [19]

Gutgsell

[11] Patent Number: 5,957,530

[45] Date of Patent: Sep. 28, 1999

[54] DEVICE FOR GANGING CHAIRS

[75] Inventor: David Gutgsell, Jasper, Ind.

[73] Assignee: Ditto Sales, Inc., Jasper, Ind.

[21] Appl. No.: 08/935,465

[22] Filed: Sep. 24, 1997

[51] Int. Cl.[6] ..... A47C 15/00

[52] U.S. Cl. ..... 297/248; 297/249; 297/232

[58] Field of Search ..... 297/248, 249, 297/232

[56] References Cited

U.S. PATENT DOCUMENTS

| | | | |
|---|---|---|---|
| 2,751,969 | 6/1956 | Kruijt | 297/248 |
| 3,594,038 | 7/1971 | Polsky . | |
| 3,742,869 | 7/1973 | Polsky et al. . | |
| 3,825,300 | 7/1974 | Lieberman et al. | 297/248 |
| 3,990,741 | 11/1976 | Snyder et al. . | |
| 4,286,891 | 9/1981 | Gerner et al. . | |
| 4,591,289 | 5/1986 | Vickers et al. | 297/248 X |
| 4,978,168 | 12/1990 | Piretti | 297/248 |
| 5,542,159 | 8/1996 | Schultz et al. | 297/248 X |

FOREIGN PATENT DOCUMENTS

| | | | |
|---|---|---|---|
| 302004 | 8/1916 | Germany | 297/248 |
| 100539 | 7/1962 | Norway | 297/248 |
| 207194 | of 0000 | Switzerland | 297/248 |

*Primary Examiner*—Laurie K. Cranmer
*Attorney, Agent, or Firm*—Beck, Michael & Beck, PC

[57] ABSTRACT

A device for ganging chairs or other articles of furniture that includes a connecting body with a pivot end and a ganging end. The pivot end includes a first clip or a recess, and the ganging end includes a second clip. The first clip or recess and the second clip releasably engage the structural frames of a first chair and a second chair. The ganging device may include protuberances for mounting the connecting body to a single chair in order to store the device under the seat. The pivot end may also be rotatably engaged to the first chair so that the device rotates from a first position in which the ganging end is releasably engaged to the second chair to a second position in which the ganging device is stored on the first chair. When in the stored position, the device is releasably engaged to the seat pan of the first chair. The connecting body may also include a middle portion for placement of a nameplate or logo. The middle portion may also include an inset for receiving visual indicia of the chair location.

21 Claims, 6 Drawing Sheets

DEVICE FOR GANGING CHAIRS

BACKGROUND OF THE INVENTION

This invention relates to a device for ganging two or more articles of furniture, such as chairs.

It is often necessary to arrange a multitude of chairs in rows to provide an orderly seating arrangement. In addition to aesthetic reasons, the orderly arrangement of chairs in rows facilitates ingress and egress when large numbers of people are gathered together. Such an arrangement also maximizes seating capacity in a room of limited size and enhances sightlines of attendees while seated at an event.

Oftentimes movable chairs are used to create a row or multiple rows of chairs, to allow flexible seating arrangements, and many different uses of the same floor space. A disadvantage to using movable chairs is that chairs may be accidentally displaced, thus causing a row to become disorganized. In addition to disturbing the aesthetic appearance of a room, the ability to easily disorganize a row of movable chairs creates a safety problem if the room's occupants are required to quickly exit, such as in case of a fire. In fact, local fire codes frequently require adjacent chairs to be interconnected in certain situations.

Interconnecting chairs greatly increases the stability of a single chair and makes it difficult to move. Thus, interconnecting chairs via a ganging device is commonly done to increase safety and enhance the aesthetic appearance of a room when a row or multiple rows of two or more chairs are required.

Devices to gang chairs have been the subject of prior patents. U.S. Pat. No. 3,825,300 to Lieberman et. al. discloses a ganging clip movably mounted to the leg of a chair to receive the leg of an adjacent chair. U.S. Pat. No. 3,594,038 to Polsky et. al. discloses ganging connectors mounted to the leg of a chair for receiving a corresponding leg of an adjacent chair.

In each of these prior patents, the ganging device is employed on the legs of adjacent chairs, is in full view, and is generally not aesthetically pleasing. Unless the ganging device is totally removed, it is visible to an ordinary observer even when it is not attached to an adjacent chair. If the ganging device is completely removable, it must be stored and is liable to be misplaced. Also, many prior devices require adjacent chairs to be placed very close together in order for the ganging device to be used. This often creates uncomfortable seating arrangements. There is, therefore, a need for a ganging device which is self-storing, aesthetically pleasing, concealed when not in use, and allows for a comfortable seating arrangement when in use.

SUMMARY OF THE INVENTION

The present invention contemplates a pivoting, concealable ganging device for connecting two chairs or other articles of furniture. The ganging device is capable of being rotated from a first position, in which the ganging device extends from the first chair to engage a horizontal member of the structural frame of a second chair, to a second position in which the device is removably engaged to the seat pan of the first chair.

In one embodiment of the invention, the ganging device has a connecting body with a pivot end and a ganging end. The ganging device is mounted to a first chair by a first fastener which pivotably engages the pivot end to the seat pan, and a second fastener which releasably engages the connecting body to the first chair. When the ganging device is used to connect a second chair to the first chair, the connecting body is released by unengaging the second fastener from the first chair. The ganging device is then rotated about its pivot end and the ganging end is releasably engaged to the second chair, causing the connecting body to span the gap between the first and second chairs.

In one aspect of the invention, the ganging device is releasably engaged in the second position via protuberances on the surface of the connecting body. The protuberances releasably engage corresponding indentations located on the seat pan of the first chair.

In another feature of the invention, the ganging device can be concealed from view by the seat pan and/or structural frame of the first chair when in the first position. This can be accomplished by placement of the first and second fastener means above the lowest elevation of the seat support and adjacent the structural frame of the first chair.

In another aspect of the invention, the connecting body can include a middle portion which provides a location for the placement of a name or logo. The middle portion can also include an inset for placement of visual indicia to identify the chair location, such as a numbered tag.

One object of the present invention is to provide a pivoting ganging device to releasably connect a first and second chair which can be stored and concealed on a first chair when not in use. Another object is to provide a chair ganging device that is concealed when not in use.

A further object is to create a chair ganging device that is aesthetically pleasing when in use. Another object is to provide a ganging device that allows the use of multiple rows of many chairs in a manner that satisfies safety and fire code requirements and maintains an orderly appearance to said rows of chairs.

Other objects, and certain benefits, of the present invention will become apparent to those of ordinary skill in the art from the following written description and accompanying figures.

DESCRIPTION OF THE PREFERRED EMBODIMENTS

Figure 1:
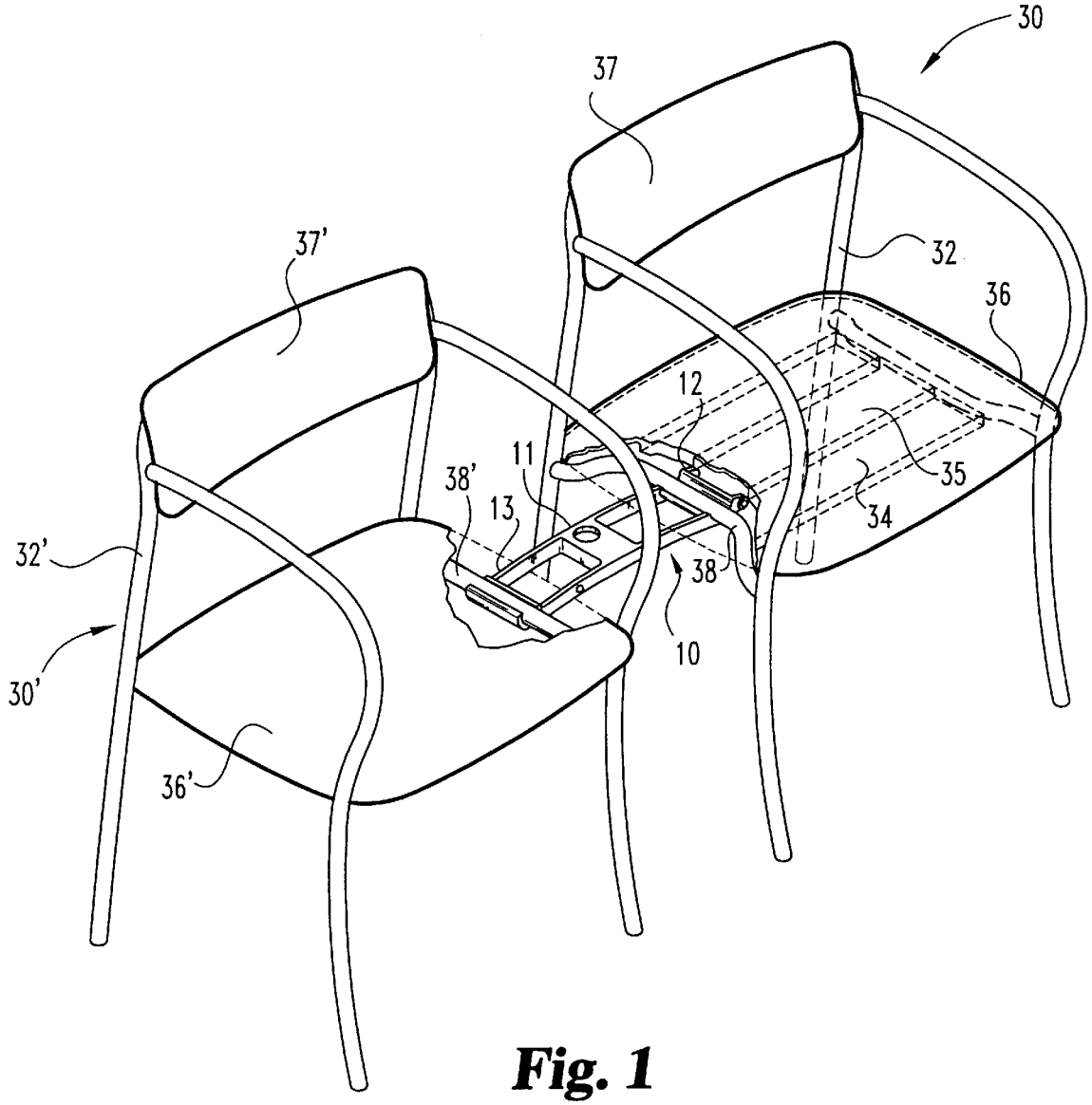
FIG. 1 is a perspective view of a chair ganging device of the present invention in its ganging position between two chairs.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
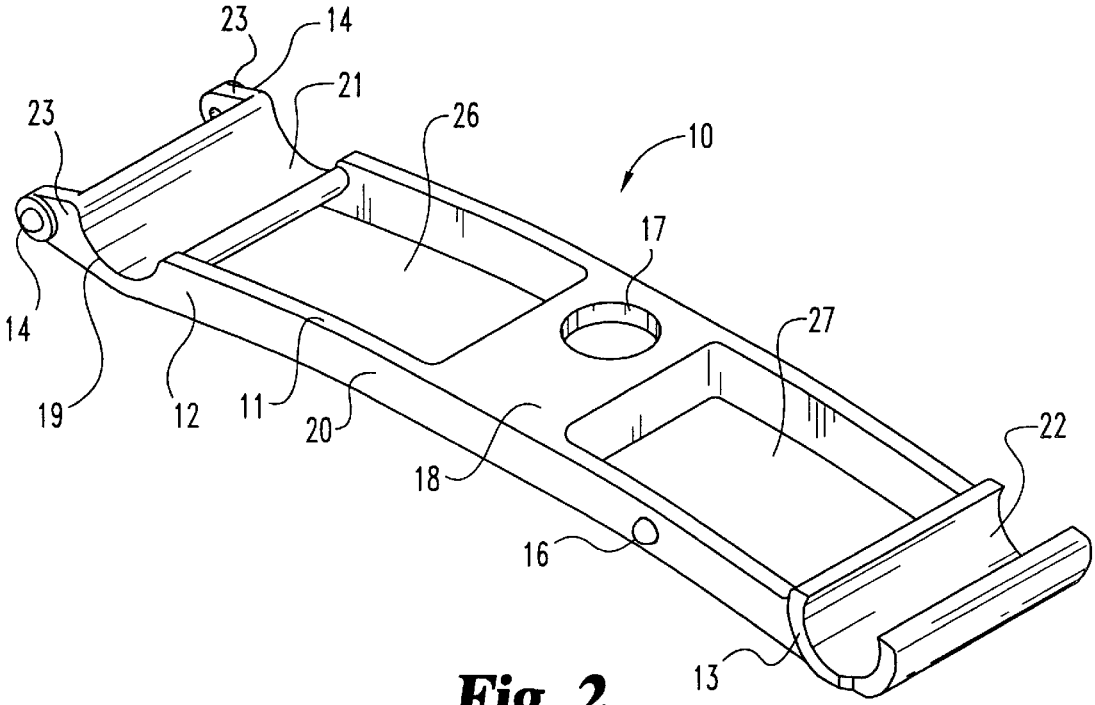
FIG. 2 is a perspective view of the chair ganging device shown in FIG. 1.

Referring first to FIGS. 1–5, one embodiment of the present invention for ganged connection of two chairs is illustrated. FIG. 1 shows ganging device 10 in ganged relation between chair 30 and chair 30', while FIG. 2 is a perspective view of a ganging device 10 in isolation. Ganging device 10 includes a connecting body 11, a pivot end 12, and a ganging end 13. Pivot end 12 is pivotably engaged to chair 30 and ganging end 13 is removably engaged to chair 30' when in the ganged position, or first position, as shown in FIG. 1. When ganging device 10 is in a stored position, or second position, ganging end 13 is rotated from the first position about pivot end 12 until the device 10 is located entirely beneath seat 36 of chair 30. The ganging device 10 may be located on each one of many chairs, all of which may be aligned in a row and secured in ganged relationship to another chair by using the ganging device 10.

Figure 5:
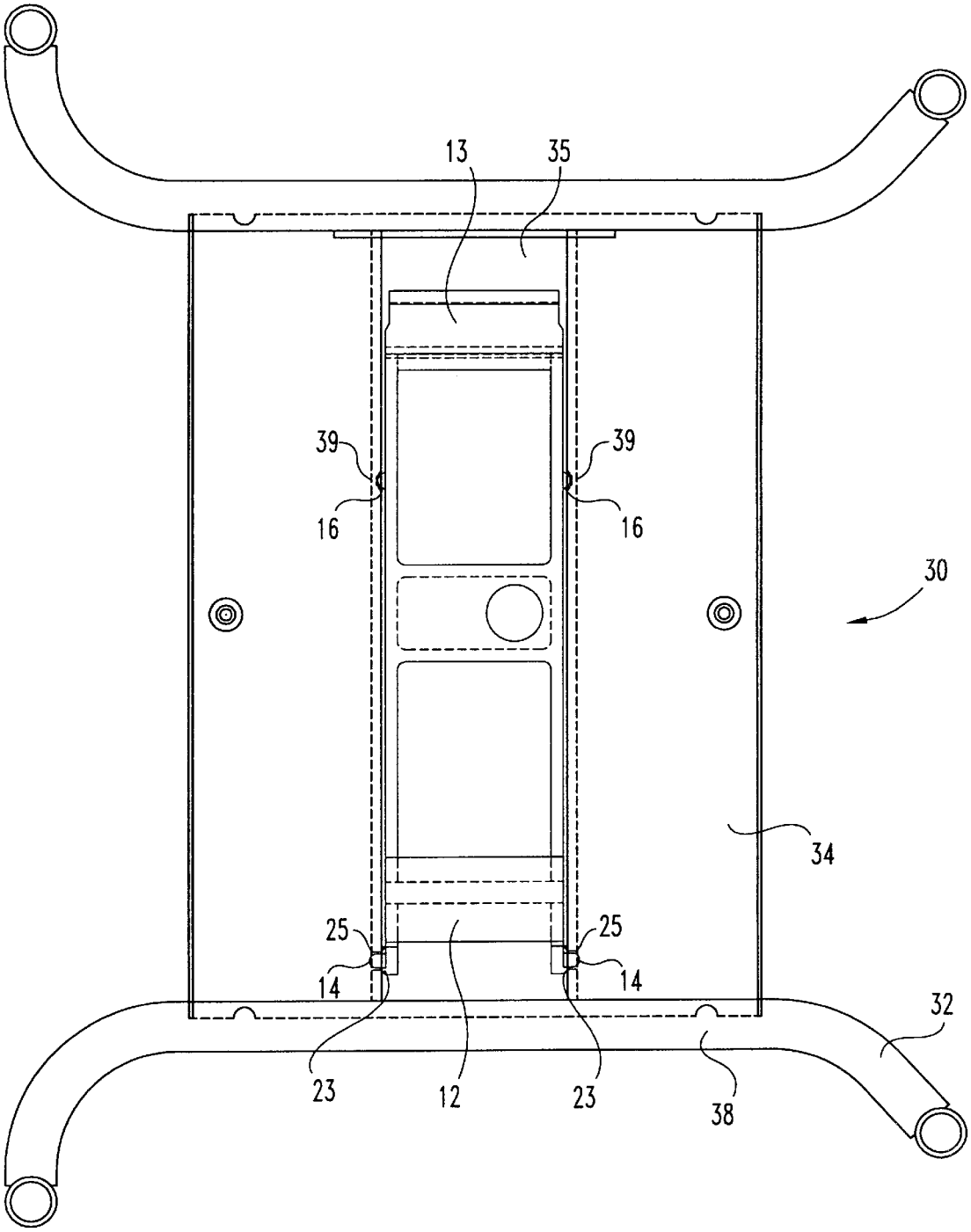
FIG. 5 is a plan view of the ganging device of FIG. 1 in its stored position beneath a chair.

Chairs 30 and 30' each have a structural frame 32 and 32' which support seats 36 and 36' and backs 37 and 37' of the chairs, respectively. Structural frames 32 and 32' include horizontal members 38 and 38', respectively. Chair 30 also includes seat pan 34 which defines channel 35 extending transversely across the chair between the two horizontal members 38 of chair 30. Channel 35 defines seat pan apertures 25 near one end and intermediate indentations 39 on its sidewalls as shown in FIG. 5.

Referring back to FIG. 1, ganging device 10 includes a connecting body 11 with a pivot end 12 and ganging end 13. Connecting body 11 is sized to span the gap between chair 30 and chair 30' when the chairs are in side by side relation. Preferably, the length of connecting body 11 is sufficient to separate chair 30 and chair 30' by a distance that allows persons to simultaneously sit in each chair in a comfortable fashion. In one specific embodiment, connecting body 11 has a length of about nine inches. Connecting body 11 is also sized to fit within channel 35 when it is placed in its stored position. In one specific embodiment, connecting body 11 has a width of about 2.75 inches, and the channel 35 has a slightly greater width of about 2.90 inches. Connecting body 11 is preferably molded from plastic, but also may be molded from any other resilient material.

Referring to FIG. 2, the preferred embodiment of connecting body 11 defines openings 26 and 27 to form a body that is lightweight and resilient. The body also includes an intermediate portion 18 having an area large enough to accommodate a nameplate. The nameplate is visible to an observer looking from above when the ganging device 10 is in the ganging position. The nameplate may be used to identify the owner or manufacturer of the chair and ganging device, for example. The intermediate portion 18 may also include an inset 17 which can be used to hold visual indicia for identifying the seat location, such as a numbered tag, when the device is in the ganged position. Other embodiments of connecting body 11 include various shapes, sizes, thicknesses, and widths so long as they span the gap between chairs 30 and 30' and provide the necessary strength and rigidity to maintain alignment of the chairs.

Figure 3:
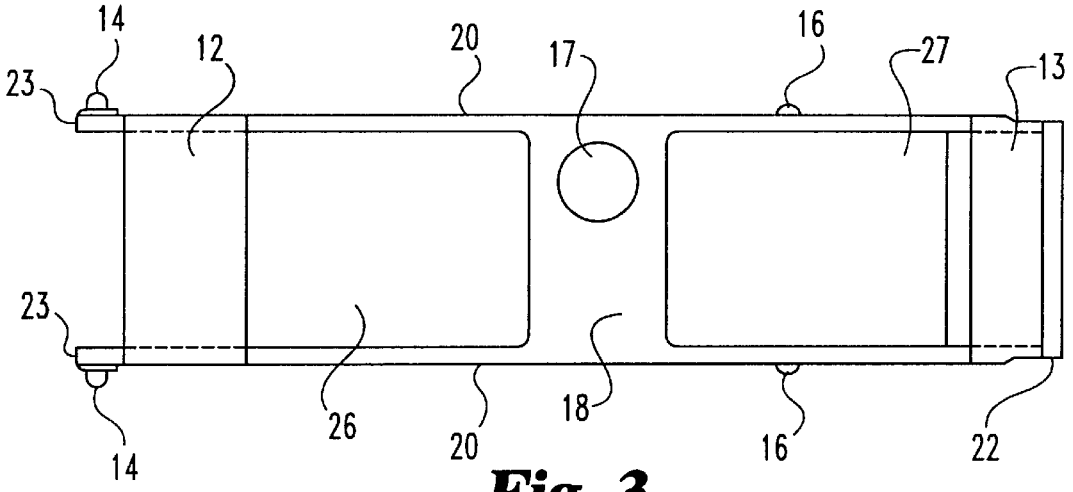
FIG. 3 is a top plan view of the ganging device shown in FIG. 2.
Figure 4:
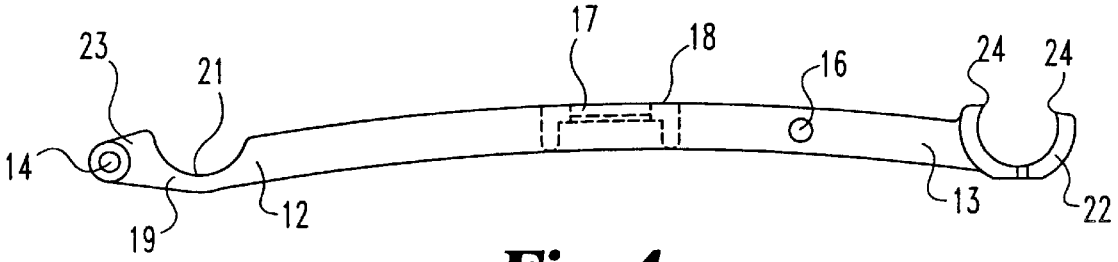
FIG. 4. is a front elevational view of the ganging device shown in FIG. 2.

The details of the pivot end 12 and ganging end 13 are shown in FIGS. 2–4. In the preferred embodiment, pivot end 12 is pivotably mounted between seat pan apertures 25 of channel 35 with first fasteners 14. Pivot end 12 allows the ganging device to rotate between its stored position and its ganged position. First fasteners 14 are preferably integrally formed on mounting tabs 23 extending from body 11. Ganging device 10 is preferably attached to channel 35 of seat pan 34 by deflecting mounting tabs 23 inward to allow first fasteners 14 to be inserted into and pivotably engage seat pan apertures 25 as shown in FIG. 5. In the preferred embodiment, first fasteners 14 are rounded protuberances integrally formed on tabs 23. Other shapes are contemplated so long as they allow ganging device 10 to pivot from a ganged position to a stored position. Alternatively, first fasteners 14 can be separate components configured to be press fitted into holes in mounting tabs 23 in the manner of a brad.

Figure 6:
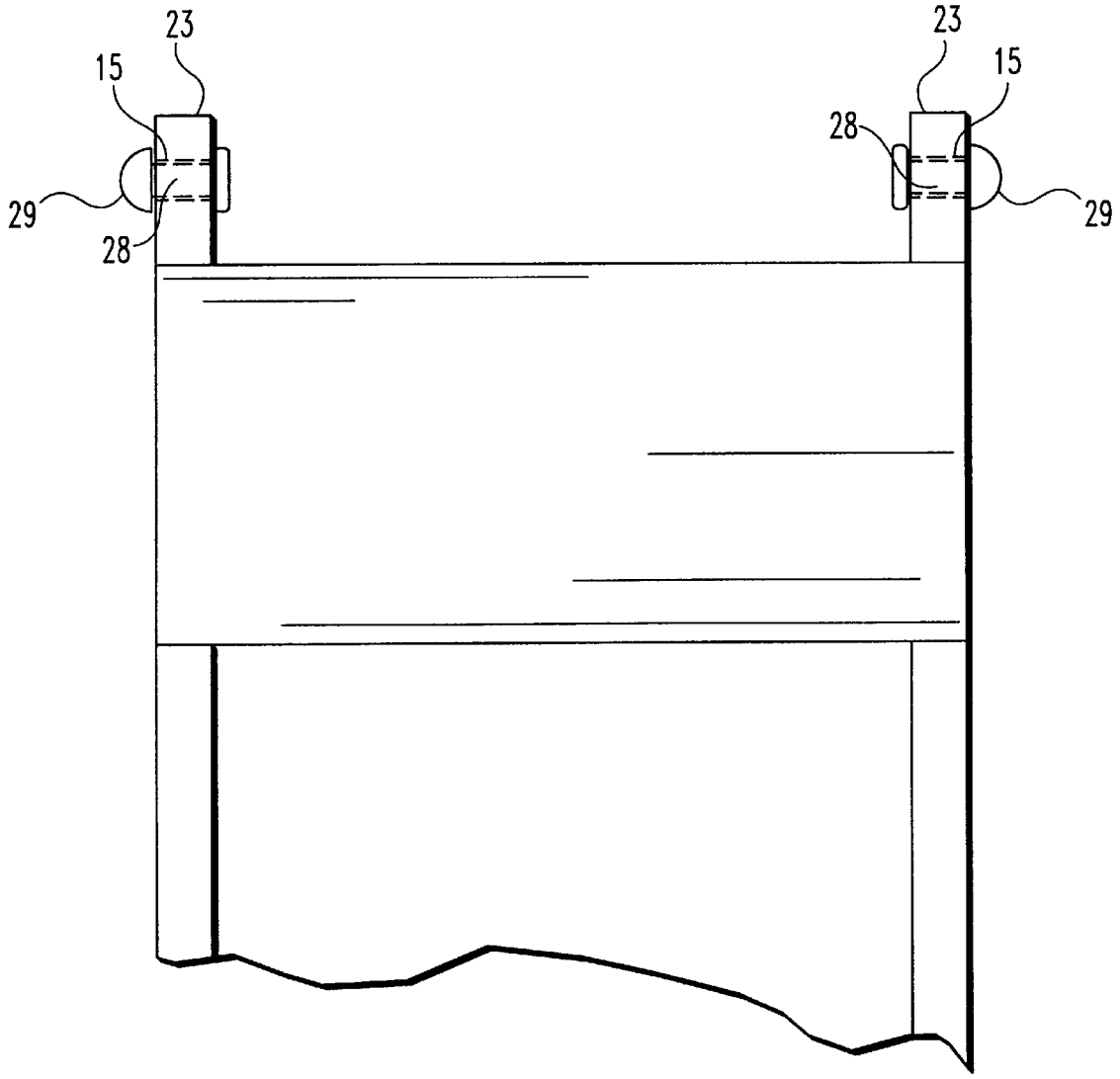
FIG. 6 is a detail view of an alternate embodiment of the pivot end of the ganging device of FIG. 2.

Referring now to FIG. 6, another embodiment of the present invention shows pivot end 12 mounted to channel 35 of seat pan 34 by pins 28. In this embodiment, pivot end 12 includes mounting tabs 23 which define apertures 15. Pins 28 are sized to extend through apertures 15, and include removable heads 29 to prevent pins 28 from becoming dislodged. Pins 28 pivotably engage seat pan 34 through seat pan apertures 25. Pins 28 may also include a single pin extending through both apertures, in which case a single head 29 may be separately attached.

Referring back to FIGS. 2 and 4, pivot end 12 also includes a recess or channel 19 that is configured to conform to the shape of horizontal member 38 of structural frame 32. When ganging device 10 is in the ganged position, contact surface 21 (of recess 19 engages horizontal member 38. Contact surface 21 increases the stability of the ganged connection by resisting lateral movement of chair 30 to which the ganging device is pivotably connected. In the preferred embodiment, recess 19 does not grippingly engage horizontal member 38, which allows for easier manipulation of the ganging device between the ganged position and its stored position. In another embodiment, recess 19 can include a contact surface 21 with a shape that grippingly engages horizontal member 38.

Connecting body 11 includes opposite side surfaces 20 that define second fasteners 16 for retaining ganging device 10 when stowed away under chair 30 in the second position. In the preferred embodiment, second fasteners 16 are rounded integral protuberances projecting outward from the opposite side surfaces 20. As shown in FIG. 5, second fasteners 16 releasably engage corresponding indentations 39 located on the sidewalls of channel 35 of seat pan 34 when ganging device 10 is in the second stored position. In one specific embodiment, protuberances 16 are located about 7.5 inches from the midpoint of recess 19. Connecting body 11 fits entirely within the sidewalls of channel 35 so that the device is fully enclosed. A modest amount of external force must be applied to the ganging device 10 as it is rotated to the second position in order to engage indentations 39. The connecting body 11 bows slightly inward at opening 27 as fasteners 16 seat within indentations 39. Other means are also contemplated for removably engaging connecting body 11 to seat pan 34, including clips, screws, or bolts.

Referring to FIG. 4, connecting body 11 includes ganging end 13 for removably engaging horizontal member 38' of chair 30' when the ganging device 10 is in the first position. Ganging end 13 includes a clip 22 that has a contact surface 23 shaped to engage horizontal member 38'. In the preferred embodiment, clip 22 is U-shaped and includes flanges 24. Flanges 24 are spaced at a distance less than the diameter of the receiving member of structural frame 32'. Preferably, clip 22 is made of resilient material that allows flanges 24 to separate as they engage receiving member 38'. Flanges 24 return to their original separation distance once clip 22 has completely engaged receiving member 38'. Flanges 24 secure clip 22 to receiving member 38' and prevent the ganged connection between chairs 30 and 30' from being easily or inadvertently broken.

Several benefits and advantages of the present invention over prior chair ganging devices can be discerned from the foregoing description. One advantage is that the ganging device 10 need not be removed when it is not in use. The ganging device may be stored under the seat 36 of chair 30 so that it is concealed when in its stored position. Another advantage is that when the ganging device is in the stored position it allows chairs to be stacked.

Connecting body 11 provides an advantage in that it allows adjacent chairs to be spaced at a distance which provides comfortable seating arrangements. Also, the pivot end 12 and ganging end 13 are generally concealed from view by seats 30 and 30', leaving only the middle portion of connecting body 11 visible. This allows ganged chairs to maintain an aesthetically pleasing appearance.

Figure 7:
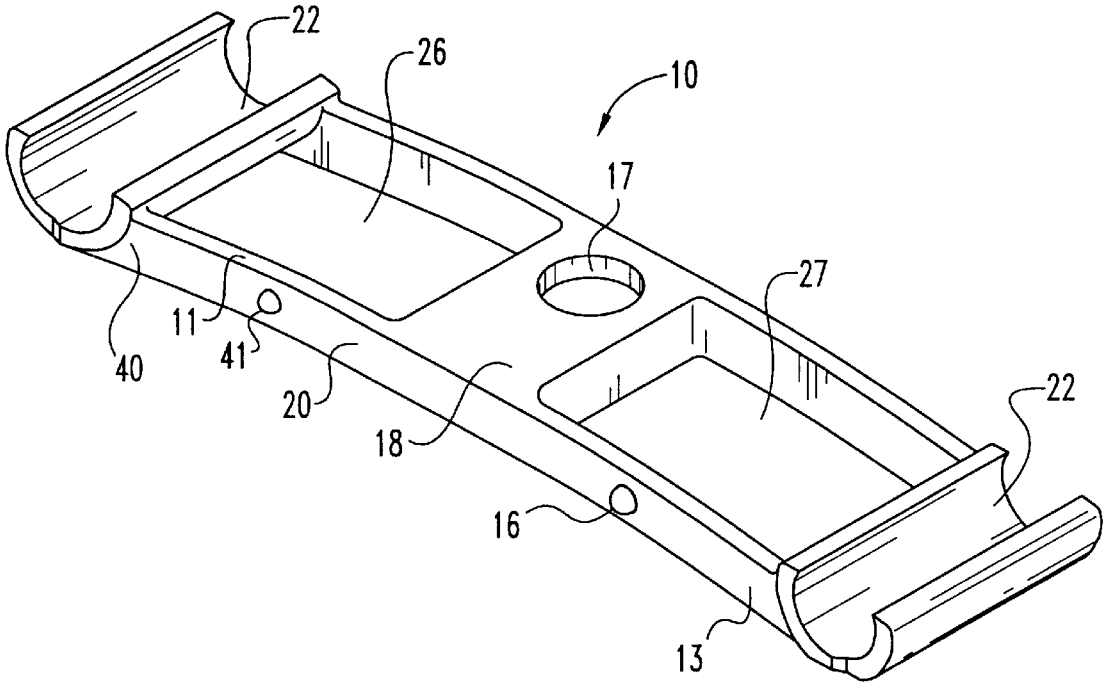
FIG. 7 is a perspective view of another embodiment of a ganging device according to the present invention.

In another embodiment of ganging device 10, shown in FIG. 7, pivot end 12 is replaced by a second ganging end 40. Second ganging end 40 has the same structure ganging end 13 shown in FIG. 4. In this embodiment, first ganging end 13 and second ganging end 40 are both removably engaged to chairs 30 and 30' when the ganging device is in the first position. Connecting body 11 may also include fastening means 16 and 41 to releasably engage the device 10 to a corresponding set of indentations in the seat pan 34 of chair 30. Since the ganging devices are completely removable, they may also be stored at some other location and used on any chair which accepts first ganging end 13 and second ganging end 40.

In another embodiment, ganging device 10 can be used to connect articles of furniture other than chairs. For example, two tables may be gangedly connected by the device so long as each table includes a component that will accept ganging ends 13 or 40, or pivotably accept pivot end 12.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A device for releasably connecting a first chair to a second chair, each said chair having a frame with a horizontal frame member, a seat pan and seat thereon, said device comprising:

a connecting body including a pivot end and a ganging end; and a fastener pivotably fastening said pivot end of said connecting body to a first chair, said connecting body pivotable about said fastener between a first position in which said ganging end is releasably engaged to the second chair, and a second position in which said body is stored beneath the seat pan of the first chair;

a clip at said ganging end configured for releasable engagement to the frame of a second chair, said clip defining a recess shaped to conform to said horizontal frame member for releasable engagement with said frame member; and means for releasably engaging said connecting body to the seat pan of said first chair when said connecting body is in the second position.

2. The device according to claim 1, wherein said means includes protuberances projecting outward from said connecting body and configured to mate with indentations in the seat pan of the first chair when said device is in said second position.

3. The device according to claim 2, wherein said connecting body includes a resilient structure in which said fastener deflects inward to rotatably engage corresponding apertures in the seat pan of the first chair and said protuberances deflect inward to releasably engage the corresponding indentations in the seat pan of the first chair.

4. The device according to claim 1, wherein said clip is U-shaped.

5. The device according to claim 1, wherein said connecting body includes a recess formed therein adjacent to said pivot end, said recess configured for engaging the horizontal frame member of the first chair to resist lateral movement thereof when said device is in said first position.

6. The device according to claim 1, wherein said connecting body includes an inset for receiving a visual indicia, said inset being visible from above when said device is in said first position.

7. The device according to claim 1, wherein said connecting body is molded from plastic.

8. The device according to claim 1, wherein said fastener includes rounded protuberances at said pivot end configured to rotatably engage corresponding apertures in the seat pan of the first chair.

9. The device according to claim 1, wherein said pivot end includes tabs projecting therefrom and said connecting body defines at least one opening between said pivot end and said clip.

10. A device for releasably connecting a first chair to a second chair, said chairs having a frame with a seat and seat pan thereon, said device comprising:

a connecting body including a pivot end and a ganging end, said connecting body defining protuberances thereon;

said seat pan defining a channel having sidewalls, said sidewalls defining seat pan apertures and indentations thereon; and means for pivotably fastening said pivot end to said seat pan apertures, said connecting body pivotable between a first ganging position connecting the first chair to the second chair and a second stored position under the first chair, whereby said pivotable fastening means rotatably engages said seat pan apertures and said protuberances releasably engage said indentations when said connecting body is in said stored position.

11. The device according to claim 10, wherein said connecting body is pivotable about said pivot end between a first position in which said ganging end releasably engages a second chair and a second position in which said device is beneath the first chair.

12. The device according to claim 11, wherein said connecting body includes an inset for receiving a visual indicia, said inset being visible from above when said device is in said first position.

13. The device according to claim 10, wherein said ganging end includes a clip.

14. The device according to claim 10, wherein said connecting body is molded from plastic.

15. The device according to claim 10, wherein said connecting body includes a flexible structure in which said pivotable fastening means deflects inward to rotatably engage said seat pan apertures and said protuberances deflect inward to releasably engage said indentations.

16. A device for releasably connecting a first article of furniture to a second article of furniture, said articles of furniture having a structural frame including a horizontal frame member for support thereof, said device comprising:

a connecting body including a first ganging end and a second ganging end for connecting the first and second articles with the device in a ganging position;

a plurality of protuberances projecting outward from said connecting body; and a plurality of indentations defined by the horizontal member of the structural frame of the first article of furniture, said indentations configured to correspond to said protuberances, wherein said protuberances releasably engage said indentations when said device is beneath the article of furniture in a stored position.

17. The device according to claim 16, wherein said first ganging end includes a clip configured for releasable engagement to the first article or furniture and said second ganging end includes a clip configured for releasable engagement to the second article of furniture.

18. The device according to claim 17, wherein said first and second clips are U-shaped.

19. The device according to claim 17, wherein said connecting body includes an inset for receiving a visual indicia, said inset being visible from above when said device is in ganged relation with the first and second articles of furniture.

20. The device according to claim 16, wherein said connecting body is made of plastic.

21. The device according to claim 16, in which said connecting body includes a flexible structure wherein said protuberances deflect inward to releasably engage said corresponding indentations.

* * * * *